US005112083A

United States Patent [19]

Morrone

[11] Patent Number: 5,112,083

[45] Date of Patent: May 12, 1992

[54] PAPER PAD CONSTRUCTION AND CLIP MEANS THEREFOR

[75] Inventor: Ross Morrone, Cranbury, N.J.

[73] Assignee: All-State Legal Supply Co., Cranford, N.J.

[21] Appl. No.: 569,801

[22] Filed: Aug. 22, 1990

[51] Int. Cl.[5] ..... B42D 1/10; B42F 3/00

[52] U.S. Cl. ..... 281/47; 281/44; 412/33

[58] Field of Search ..... 281/44, 45, 46, 47, 281/48; 412/8, 16, 33

[56] References Cited

U.S. PATENT DOCUMENTS

| | | | |
|---|---|---|---|
| 1,906,371 | 5/1933 | Dreifuss | 281/44 |
| 2,068,280 | 1/1937 | Schade . | |
| 2,195,677 | 4/1940 | Moody et al. . | |
| 2,568,564 | 9/1951 | Slonneger . | |
| 2,591,351 | 4/1952 | Gray . | |
| 2,690,023 | 9/1954 | Jackson et al. . | |
| 2,965,394 | 12/1960 | Bresler | 281/44 |
| 3,105,495 | 10/1963 | Heyer . | |
| 3,968,546 | 7/1976 | Seaborn et al. | 281/44 X |
| 4,351,546 | 9/1982 | Cognata | 281/45 |
| 4,557,503 | 12/1985 | Linn | 281/47 |
| 4,758,022 | 7/1988 | Podosek et al. . | |
| 4,867,479 | 9/1989 | Mizutani . | |

*Primary Examiner*—Timothy V. Eley
*Assistant Examiner*—Peter Dungba Vo
*Attorney, Agent, or Firm*—Sperry, Zoda & Kane

[57] ABSTRACT

A paper pad securement clip for use with a paper pad having a plurality of paper sheet members and optionally including a backing member. The paper pad presents a base surface and an upper surface with the individual sheet members edge glued together. The paper securement clip has a base member secured with respect to the lower end and an upper member secured with respect to the upper end. The base member includes a base member end and a first obliquely angled tip member. A first abutment surface is defined thereon also. The upper member defines an upper member end and a second obliquely angled tip having a second abutment surface. The first and second abutment surfaces are operative to secure the individual paper sheet members of the paper pad together with respect to one another and facilitate removal of individual sheets therefrom. The pad securement device optionally includes a removal arm extending outwardly therefrom defining a cutting edge thereon. A display area may also be defined on the upper surface of the upper member of the pad securement clip to facilitate display of appropriate information thereon.

20 Claims, 4 Drawing Sheets

PAPER PAD CONSTRUCTION AND CLIP MEANS THEREFOR

BACKGROUND OF THE INVENTION

1. Field Of The Invention

The present invention applies to the field of art of paper pads for use as writing substrates more commonly referred to as "legal pads". In the conventional configuration such legal pads are formed with a plurality of individual sheet members having a chipboard backing member thereunder and a header strip extending across the uppermost area of the top section. A staple securement member is then placed therethrough perforating firstly the header strip, and then the individual sheet members and finally perforating and clipping about the chipboard backing member. Finally an end tape means is placed extending about the header strip, the paper pad and thereunder to extend around the uppermost portion of the chipboard backing member. This prior art configuration requires a significant amount of assembly time and individual assembly steps. The present invention provides a novel means for replacing the individual steps and separate staple securement means required heretofore.

2. Background Of The Invention

Prior art paper pad binding constructions have been shown in a number of patents such as U.S. Pat. No. 2,068,280 patented Jan. 19, 1937 to F. Schade on a Pack Binding Construction; U.S. Pat. No. 2,195,677 patented Apr. 2, 1940 to R. Moody et al on a Telephone Memorandum Pad; U.S. Pat. No. 2,568,564 patented Sept. 18, 1951 to B. Slonneger on a Sheet Holder; U.S. Pat. No. 2,591,351 patented Apr. 1, 1952 to C. Gray on a Note Pad And Note Sheet Holder; U.S. Pat. No. 2,690,023 patented Sep. 28, 1954 to V. Jackson Jr. on a Palette-Sheet Holder; U.S. Pat. No. 3,105,495 patented Oct. 1, 1963 to A. Heyer on a Desk Pad; U.S. Pat. No. 4,758,022 patented Jul. 19, 1988 to E. Podosek et al on a Writing Tablet With Two-Ply Cover; and U.S. Pat. No. 4,867,479 patented Sep. 19, 1989 to S. Mizutani on a Slide File.

SUMMARY OF THE INVENTION

The present invention provides a paper pad configuration including a plurality of individual paper sheet member stacks vertically upon one another such as to define a base surface therebelow and an upper surface thereabove. An edge gluing configuration extends along one edge of the paper pad means to facilitate initial retainment of the individual paper sheet members with respect to one another.

A pad securement clip includes an end member extending over one edge of the paper pad device and over the edge gluing configuration thereof to facilitate retainment of the individual sheet members with respect to one another. The end member includes an upper end and a lower end defined thereon. A base member is also secured with respect to the lower end of the end member and extends outwardly therefrom across the base surface of the paper pad. The base member is flexibly resilient to exert an upwardly directly bias against the base surface of the paper pad to facilitate retainment of the individual sheet members included. The base member includes a base member end having a first obliquely angled tip member to facilitate exertion of the upwardly directed bias against the paper pad.

The pad securement clip further includes an upper member secured with respect to the upper end of the end member and extending outwardly therefrom across the upper surface of the paper pad. The upper member is of a flexibly resilient material in such a manner as to exert a downwardly directed bias against the upper surface of the paper pad to facilitate retainment of the individual paper sheet members included therein. This upper member includes an upper member end means having a second obliquely angled tip member to facilitate exertion of the downwardly directed bias against the paper pad. Preferably the first obliquely angled tip member includes a first abutment surface angularly oriented with respect to the base surface of the pad securement clip at approximately 60 degrees with respect thereto.

The edge gluing means may be positioned along the shorter end of the paper pad or along the longer end of the paper pad, that is, along the uppermost edge or along one of the side edges to provide alternative final pad constructions for various utilitarian purposes.

In an alternative configuration an improved paper pad securement clip may be configured to be used with a paper pad having a plurality of individual sheet members similarly stacked vertically upon one another. This paper pad may also include a base surface therebelow and an upper surface thereabove with an edge gluing means extending along one edge thereof.

With this alternative configuration an end member is positioned extending over one edge of the paper pad and over the edge gluing means thereof to facilitate retainment of the individual sheet members with respect to one another. The end member may include an upper end and a lower end. The clip device further includes a base member secured with respect to the lower end of the end member to extend outwardly therefrom across the base surface of the paper pad. The base member includes a base abutment arm extending upwardly therefrom and being approximately perpendicular with respect to the pad. The base member is flexibly resilient to urge the base abutment arm to exert an upwardly directed bias against the base surface of the paper pad to facilitate retainment of the individual paper sheet members included within the pad.

In a similar manner the clip member may include an upper member secured with respect to the upper end of the end member such as to extend outwardly therefrom across the upper surface of the paper pad. The upper member includes an upper abutment arm extending downwardly therefrom and being approximately perpendicular with respect thereto. The upper member is flexibly resilient to urge the upper abutment arm to exert a downwardly directed bias against the upper surface of the paper pad to facilitate retainment of the individual sheet members included within the paper pad itself.

The clip means may further include a removal arm secured with respect to the upper member such as to extend downwardly and outwardly therefrom to abut the upper surface of the paper pad at an oblique angle with respect thereto. This removal arm preferably includes a cutting edge thereon being flexibly biased into abutment with the upper surface of the paper pad to facilitate removal of individual sheet means therefrom and to maintain securement with respect to the paper pad despite removal of one or more of the individual sheet members from the pad.

It is an object of the present invention to provide an improved paper pad construction and clip means for use therewith wherein cost of construction is minimized.

It is an object of the present invention to provide an improved paper pad construction and clip means for use therewith wherein maintenance costs are minimized.

It is an object of the present invention to provide an improved paper pad construction and clip means for use therewith wherein environmental conservation is considered.

It is an object of the present invention to provide an improved paper pad construction and clip means for use therewith wherein re-usability of the clip means is enhanced.

It is an object of the present invention to provide an improved paper pad construction and clip means for use therewith wherein the capability for display of additional information on the upper surface of the clip means is facilitated.

It is an object of the present invention to provide an improved paper pad construction and clip means for use therewith wherein the use of one or more staple means extending through the entire pad is no longer required.

It is an object of the present invention to provide an improved paper pad construction and clip means for use therewith wherein the use of a header strip across the upper edge of the uppermost surface of the paper pad is limited.

It is an object of the present invention to provide an improved paper pad construction and clip means for use therewith wherein the use of a tape means extending around the upper end of the pad is no longer required.

It is an object of the present invention to provide an improved paper pad construction and clip means for use therewith wherein top edge glued or side edge glued paper pads is made possible.

It is an object of the present invention to provide an improved paper pad construction and clip means for use therewith wherein use of a clip repeatedly merely with the replacement of the paper pad configuration thereof is made possible.

It is an object of the present invention to provide an improved paper pad construction and clip means for use therewith wherein a personalized writing pad is made available merely by the continuous replacement of the paper sheets held therein.

It is an object of the present invention to provide an improved paper pad construction and clip means for use therewith wherein use with various different sizes of paper pads is made possible.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
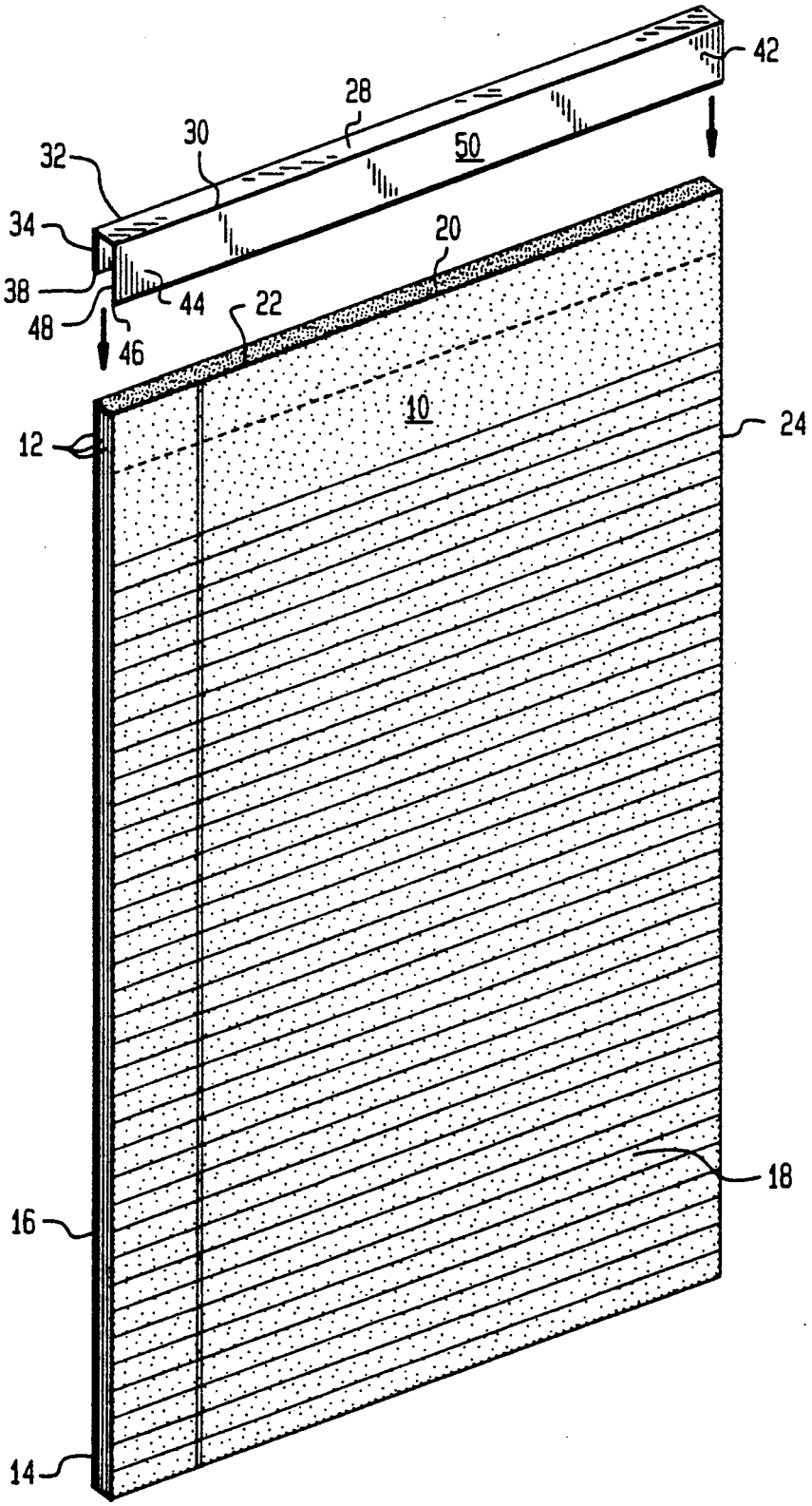
FIG. 1 is a perspective illustration of an embodiment of the improved paper pad construction and clip means for use therewith as defined in the present invention.

The present invention provides an improved paper pad construction and clip means for use therewith including a paper pad 10 having a plurality of individual paper pad sheet members 12 defined therein.

A backing member 14 may be secured to the bottom of the lowermost paper sheet member 12. The paper pad 10 defines an upper surface 18 thereabove and a base surface 16 therebelow.

Figure 5:
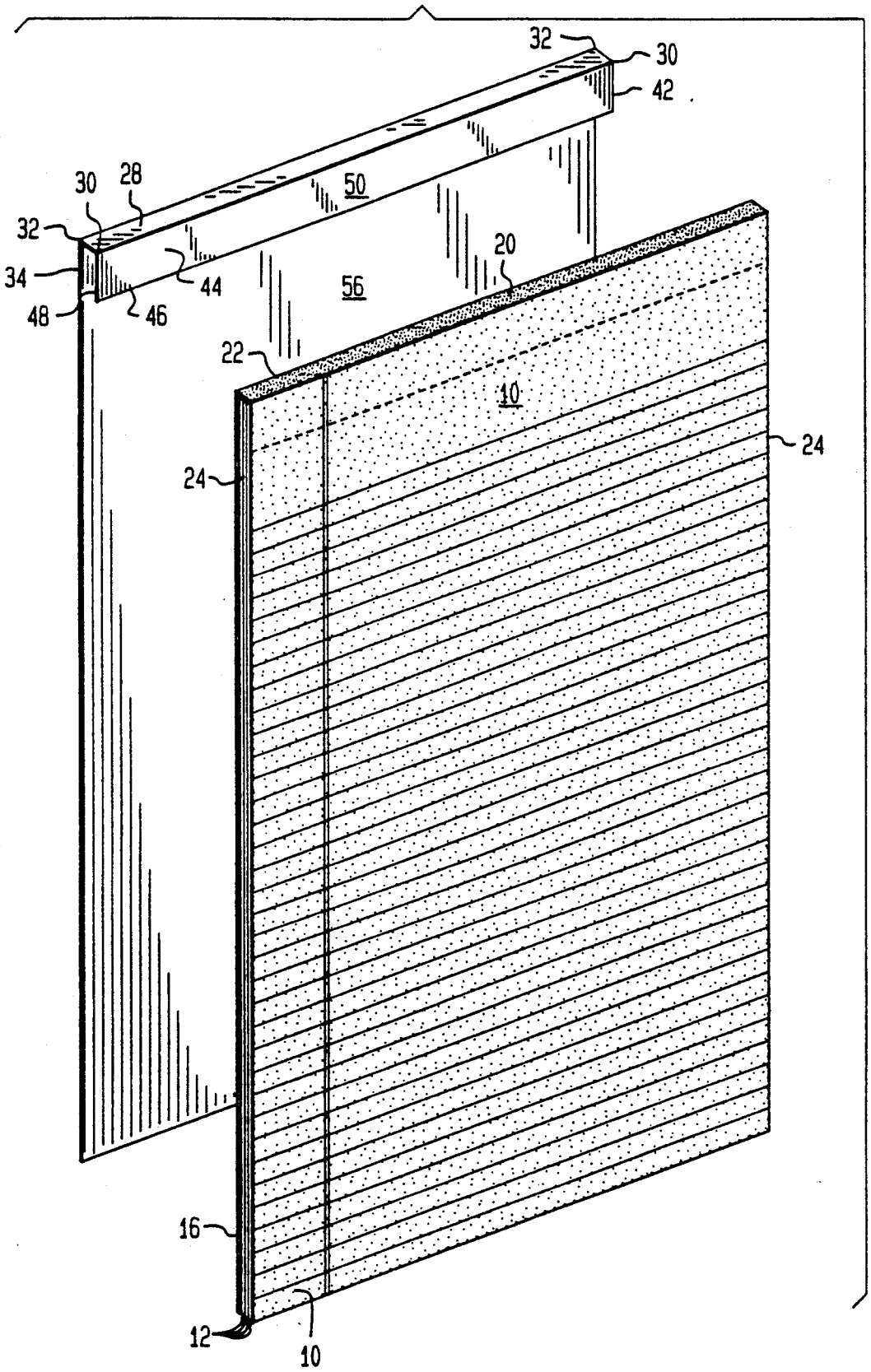
FIG. 5 is an alternative configuration showing a fixed backing plate secured with respect to the clipping means of the present invention.

An edge gluing means 20 may be secured along one edge of the paper pad 10 in such a manner as to detachably secure the individual sheet members 12 with respect to one another. Edge gluing means 20 may extend along the uppermost edge thereof which is the shorter edge of a conventional $8\frac{1}{2}''\times 11''$ or $8\frac{1}{2}''\times 14''$ sheet in the normally conventional manner or may be positioned along the longer side of such sized paper pads to provide a side secured paper pad as desired. Shorter upper edge 22 and longer side edge 24 are shown best at FIG. 5.

A pad securement clip means 26 is included having an end member 28 defining an upper end 30 and a lower end 32 thereon. Base member 34 is fixedly secured with respect to the lower end 32 in such a manner as to be flexibly resilient and movable therewith. Base member 34 includes a base member end means 36 and a first obliquely angled tip member 38 with a first abutment surface 40. First abutment surface 40 is adapted to exert a bias against the paper pad 10 upwardly thereon in order to facilitate securement of the individual paper sheet members 12 with respect to one another and to provide overall strength and structure to the finally clipped paper pad construction. This upwardly directed bias results from the flexible resilience of the base member 34.

Figure 6:
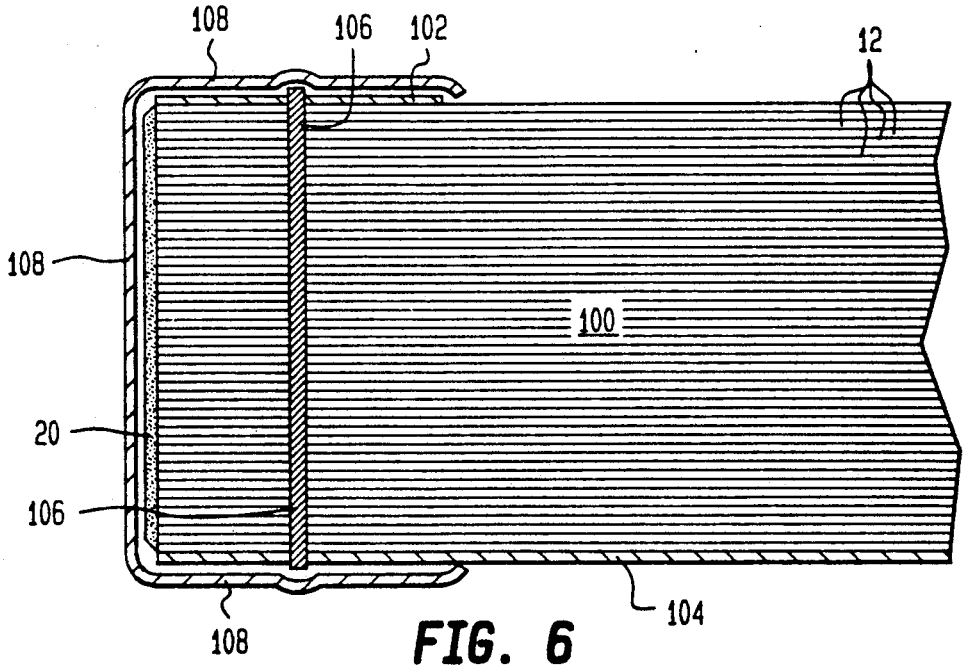
FIG. 6 (PRIOR ART)
FIG. 6 is a side cross-sectional view of an illustration of the prior art conventional paper pad construction.
Figure 3:
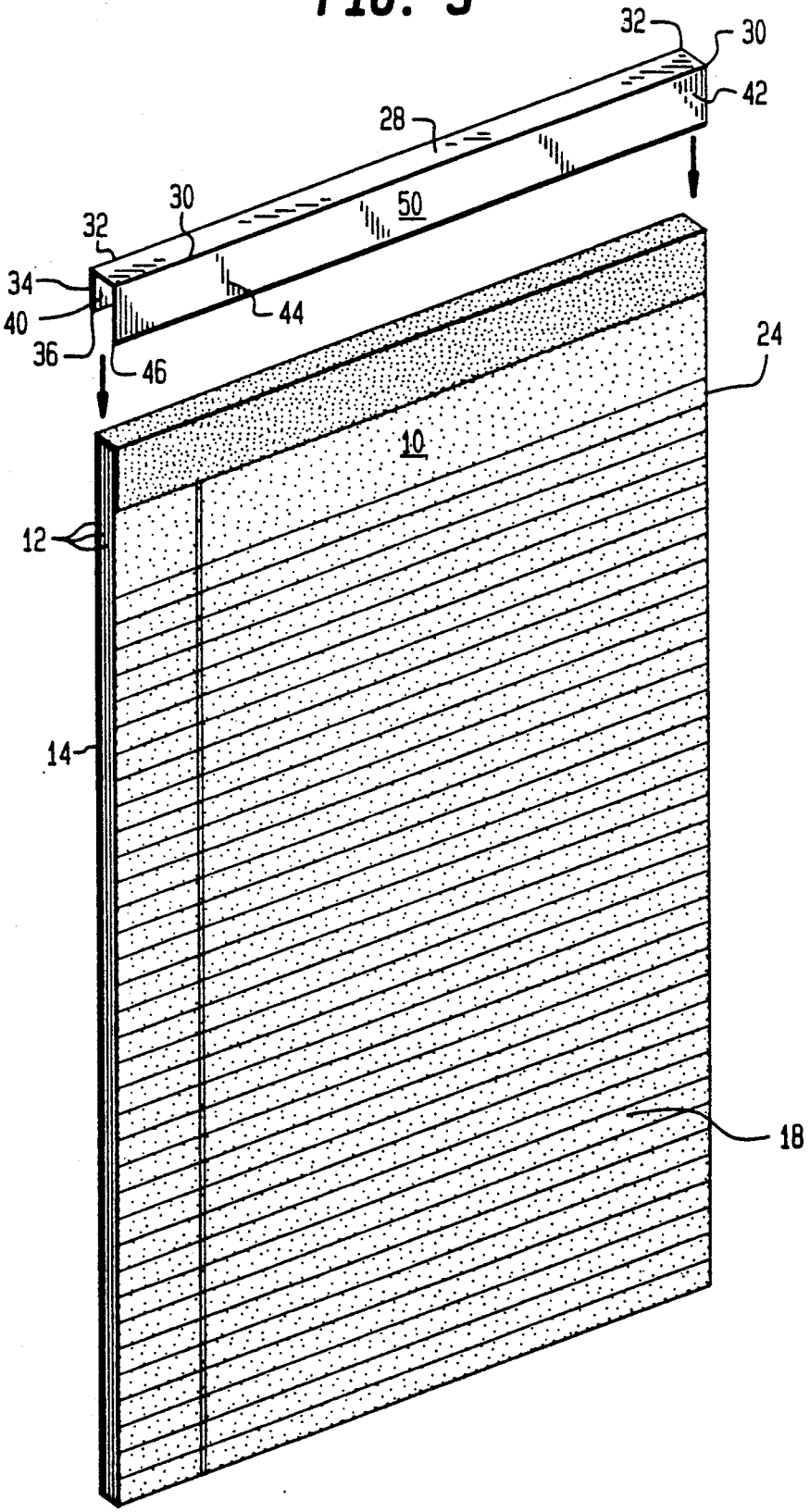
FIG. 3 is a perspective illustration of an embodiment of the configuration shown in FIG. 1.

In a similar manner an upper member 42 may include an upper member end means 44 having a second obliquely angled tip member 46 and a second abutment surface 48. The second abutment surface 48 is preferably vertically aligned with the first abutment surface 40 such that a downwardly directed bias is exerted against the paper pad 10 for facilitating detachable securement with the paper sheet members 12 with respect to one another. Thus the combination of the upwardly directed bias by the first abutment surface 40 and the downwardly directed bias by the second abutment surface 48 when viewed in combination with the flexible resilience of the material from which the base member 34 and the upper member 42 are constructed will provide an overall strength of construction allowing the omission of the use of the staple securement means 106 shown in prior art FIG. 6. In this prior art configuration the prior art paper pad 100 is shown having the header strip 102 extending across the uppermost portion thereof. A chipboard backer is positioned below the lowermost individual paper sheet of the paper pad 100. The staple securement means 106 extends through the header strip and then through the paper pad and through the chipboard backer 104 therebelow. An end tape means 108 then extends about this entire configuration for general securement thereof with respect to one another. The present invention provides a means for removing the requirement of the end tape means 108 and the staple securement means 106. Also the chipboard backing 104 is not necessarily required with the present invention. However, prior art paper pads 100 which may include such chipboard backers 104 are still usable with the clipping means of the present invention.

The pad securement clip means 26 of the present invention may also define a display area 50 in the uppermost portion thereof which allows the placement of personalized information such as an individual's name, a company name or a law firm name in order to provide increased information as desired for display thereon. In this manner when the clip means is re-used successively with paper pads 10 each use will include the personalized information displayed prominently thereon rather than requiring repetitive printing of such information on the individual sheets themselves which has been found to be quite costly and time consuming.

The pad securement clip means 26 of the present invention may include a removal arm means 52 extending upwardly and outwardly thereof having a cutting edge 54 defined thereon. This cutting edge facilitates removal of individual sheet members. Normally the usage of a cutting edge will be in combination with an upper abutment arm 58 and a lower abutment arm 60. Upper abutment arm 58 is defined to extend downwardly from the upper member 42 to be approximately perpendicular with respect to the paper pad 10 to exert a vertically downwardly directed bias thereon. In a similar manner the lower abutment arm 60 is adapted to be secured with respect to the base member 34 in such a manner as to exert an upwardly directed bias perpendicular with respect to the paper pad 10 and particularly against the base surface 16 thereof. With this configuration the paper pad construction 10 will be secured in place and the removal arm means 52 extending outwardly therefrom will place the cutting edge 54 in a position gently biasing against the uppermost surface of the uppermost paper sheet member 12. When it is desired that an individual paper sheet 12 be removed from the upper surface of the pad the user will pull upwardly thereby activating operation of the cutting edge 54 facilitating removal thereof. This removal is accomplished without requiring perforation in the individual sheet member as is often required in the prior art. The removal arm 52 will preferably be of a flexibly resilient material to exert downwardly bias of the cutting edge 54 against the upper surface 18 of paper pad 10. With this configuration as individual sheet members are removed the removal arm will move slightly downwardly continually exerting bias in the abutment of the cutting edge 54 with respect to the pad 10. In this manner abutment between cutting edge 54 and the paper pad 10 will be maintained until there are no more individual paper sheet members 12 remaining within the pad construction.

As such the present invention provides a novel means for securing a plurality of individual paper sheet members 14 with respect to one another including major advantages in cost savings. The same securement clip 26 may be used repeatedly with numerous individual paper pad configurations merely by the replacement of the stack of individual sheet members 12. In this manner the personalized information displayed in display area 50 will be used during the time of usage of numerous different pad installations. The use of the paper pad securement clip means 26 of the present invention is environmentally advantageous in view elimination of the requirement of the cardboard header strip as well as the elimination of the requirement of the staple securement means 106. Also and optionally the chipboard backing member 104 may be eliminated whenever the pad securement clip means 26 includes the fixed backing plate 56.

Figure 2:
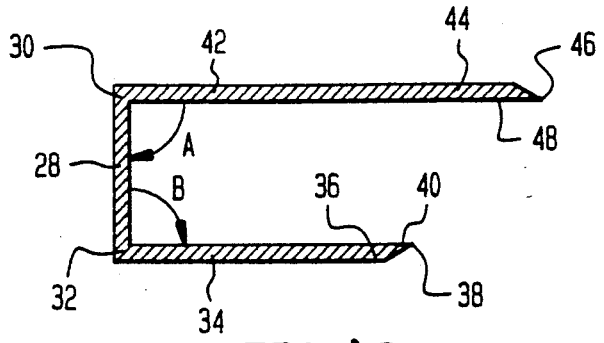
FIG. 2 is a side cross-sectional view of an embodiment of the clipping means as shown in FIG. 1.
Figure 4:
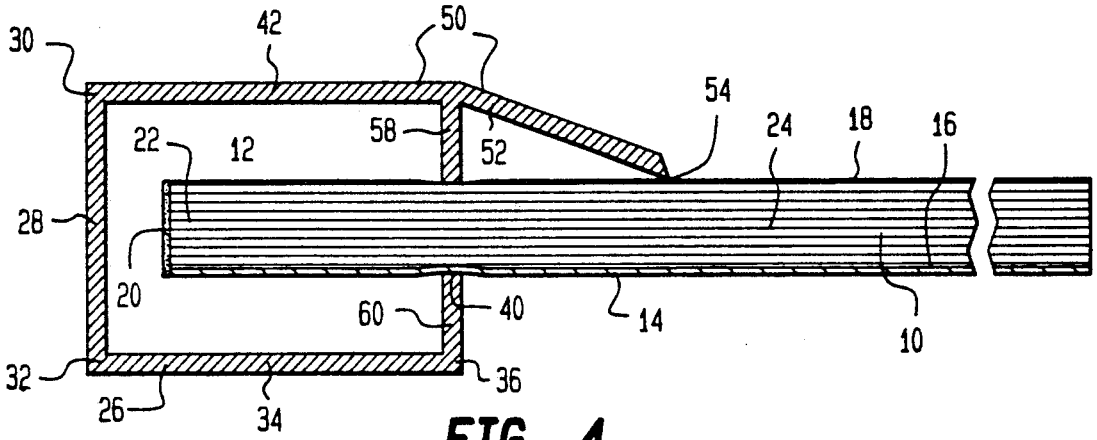
FIG. 4 is a side cross-sectional view of an alternative embodiment of the clipping means of the present invention including the removal arm shown thereon.

Effective operations of the paper pad construction and specifically the configuration of the clip of the present invention is enhanced by the formulation of the clip as shown in FIG. 2 to have the upper member 42 inclined slightly downwardly wit respect to the end member 28. In this manner the angle A as shown in FIG. 2 will be slightly less than 90 degrees. In a similar manner it has been found to be advantageous that the base member 34 is slightly angled upwardly with respect to the end member 28 such that the angle indicated in FIG. 2 as angle B is slightly less than 90 degrees. The angles A and B can be configured at 90 degrees but a preferred configuration includes the possibility of forming angles A and B at slightly less than 90 degrees.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A paper pad construction comprising:

(a) a paper pad means including a plurality of individual paper sheet members stacked vertically upon one another, said paper pad means defining a base surface therebelow and an upper surface thereabove;

(b) an edge gluing means extending along one edge of said paper pad means to facilitate initial retainment of said individual paper sheet members with respect to one another;

(c) a pad securement clip means comprising:

(1) an end member extending over one edge of said paper pad means over said edge gluing means to facilitate retainment thereof, said end member including an upper end and a lower end defined thereon;

(2) a base member secured with respect to said lower end of said end member and extending outwardly therefrom across said base surface of said paper pad means, said base member being flexibly resilient to exert an upwardly directed bias against said base surface of said paper pad means to facilitate retainment of said individual paper sheet members included therein, said base member including a base member end means including a first obliquely angled tip member to facilitate exertion of the upwardly directed bias against said paper pad means; and (3) an upper member secured with respect to said upper end of said end member and extending outwardly therefrom across sad upper surface of said paper pad means, said upper member extending outwardly from said end member to a distance greater than the lateral distance which said base member extends from said end member to facilitate downwardly directed bias therefrom and to facilitate removal of individual paper sheet members from said paper pad, said upper member being flexibly resilient to exert a downwardly directed bias against said upper surface of said paper pad means to facilitate retainment of said individual paper sheet members included therein, said upper member including an upper member end means including a second obliquely angled tip member to facilitate exertion of the downwardly directed bias against said paper pad means.

2. A paper pad construction as defined in claim 1 wherein said first obliquely angled tip member includes a first abutment surface angularly oriented with respect to said base surface of said pad securement clip means.

3. A paper pad construction as defined in claim 2 wherein said first abutment surface is oriented at approximately 60 degrees with respect to said base surface of said pad securement clip means.

4. A paper pad construction as defined in claim 1 wherein said second obliquely angled tip member includes a second abutment surface angularly oriented with respect to said upper surface of said pad securement clip means.

5. A paper pad construction as defined in claim 4 wherein said second abutment surface is oriented at approximately 60 degrees with respect to said upper surface of said pad securement clip means.

6. A paper pad construction as defined in claim 1 wherein said edge gluing means is positioned along a shorter upper edge of said paper pad means and said pad securement clip means extends thereover.

7. A paper pad construction as defined in claim 1 wherein said edge gluing means is positioned along a longer side edge of said paper pad means and said pad securement clip means extends thereover.

8. A paper pad construction as defined in claim 1 wherein said paper pad means includes a backing member of material more rigid than said individual paper sheet members extending over said base surface thereof to be positioned between said base surface and said base member of said pad securement clip means.

9. A paper pad construction as defined in claim 1 wherein said base member and said end member of said pad securement clip means are integral with respect to one another.

10. A paper pad construction as defined in claim 1 wherein said upper member and said end member of said pad securement clip means are integral with respect to one another.

11. A paper pad construction as defined in claim 1 further including a display area defined on the top surface of said upper member of said pad securement clip means to facilitate display of wording as desired.

12. A paper pad construction as defined in claim 1 wherein said base member of said pad securement clip means extends outwardly from said end member thereof at an angle of less than 90 degrees.

13. A paper pad construction as defined in claim 1 wherein said upper member of said pad securement clip means extends outwardly from said end member thereof at an angle of less than 90 degrees.

14. A paper pad construction comprising:

(a) a paper pad means including a plurality of individual paper sheet members stacked vertically upon one another and a backing member of material more rigid than said individual paper sheet members, said paper pad means defining a base surface therebelow and an upper surface thereabove;

(b) an edge gluing means extending along one edge of said paper pad means to facilitate initial retainment of said individual paper sheet members with respect to one another;

(c) a pad securement clip means comprising:

(1) an end member extending over one edge of said paper ad means over said edge gluing means to facilitate retainment thereof, said end member including an upper end and a lower end defined thereon;

(2) a base member integral with respect to said lower end of said end member and extending outwardly therefrom at approximately 90 degrees with respect thereto across said backing member of said paper pad means, said base member being flexibly resilient to exert an upwardly directed bias against said backing member of said paper pad means to facilitate retainment of said individual paper sheet members included therein, said base member including a base member end means including a first obliquely angled tip member to facilitate exertion of the upwardly directed bias against said paper pad means, said first obliquely angled tip member including a first abutment surface angularly oriented with respect to said base surface of said pad securement clip means at approximately 60 degrees with respect thereto;

(3) an upper member integral with respect to said upper end of said end member and extending outwardly therefrom at approximately 90 degrees with respect thereto across said upper surface of said paper pad means, said upper member extending outwardly from said end member to a distance greater than the lateral distance which said base member extends from said end member to facilitate downwardly directed bias therefrom and to facilitate removal of individual paper sheet members from said paper pad, said upper member being flexibly resilient to exert a downwardly directed bias against said upper surface of said paper pad means to facilitate retainment of said individual paper sheet members included therein, said upper member including an upper member end means including a second obliquely angled tip member to facilitate exertion of the downwardly directed bias against said paper pad means, said second obliquely angled tip member including a second abutment surface angularly oriented with respect to said upper surface of said pad securement clip means at approximately 60 degrees with respect thereto; and (4) a display area defined on the top surface of said upper member of said pad securement clip means to facilitate display of working as desired.

15. An improved paper pad securement clip means for use with a paper pad means including a plurality of individual paper sheet member stacked vertically upon one another, the paper pad means defending a base surface therebelow, an upper surface thereabove, and an edge gluing means extending along one edge of the paper pad means to facilitate initial retainment of the individual paper sheet members with respect to one another, said improved paper pad securement clip means comprising:

(a) an end member extending over one edge of the paper pad means over the edge gluing means to facilitate retainment thereof, said end member including an upper end and a lower end defined thereon;

(b) a base member secured with respect to said lower end of said end member and extending outwardly therefrom across the base surface of the paper pad means, said base member being flexibly resilient to exert an upwardly directed bias against the base surface of the paper pad means to facilitate retainment of the individual paper sheet members included therein, said base member including a bas member end means including a first obliquely angled tip member to facilitate exertion of the upwardly directed bias against the paper pad means; and (c) an upper member secured with respect to said upper end of said end member and extending outwardly therefrom across the upper surface of the paper pad means, said upper member extending outwardly from said end member to a distance greater than the lateral distance which said base member extends from said end member to facilitate downwardly directed bias therefrom and to facilitate removal of individual paper sheet members from said paper pad, said upper member being flexibly resilient to exert a downwardly directed bias against the upper surface of the paper pad means to facilitate retainment of the individual paper sheet members included therein, said upper member including an upper member end means including a second obliquely angled tip member to facilitate exertion of the downwardly directed bias against the paper pad means.

16. An improved paper pad securement clip means for use with a paper pad means including a plurality of individual paper sheet members tacked vertically upon one another, the paper pad means defining a base surface therebelow, an upper surface thereabove, and an edge gluing means extending along one edge of the paper pad means to facilitate initial retainment of the individual paper sheet members with respect to one another, said improved paper pad securement clip means comprising:

(a) an end member extending over one edge of the paper pad means over the edge gluing means to facilitate retainment thereof, said end member including an upper end and a lower end defined thereon;

(b) a base member secured with respect to said lower end of said end member and extending outwardly therefrom across the base surface of the paper pad means, said base member including a base abutment arm extending upwardly therefrom and being approximately perpendicular with respect thereto, said base member being flexibly a resilient to urge said base abutment rm to exert an upwardly directed bias against the base surface of the paper pad means to facilitate retainment of the individual paper sheet members included therein;

(c) an upper member secured with respect to said upper end of said end member and extending outwardly therefrom across the upper surface of the paper pad means, said upper member including an upper abutment arm extending downwardly therefrom and being approximately perpendicular with respect thereto, said upper member being flexibly resilient to urge said upper abutment arm to exert a downwardly directed bias against the upper surface of the paper pad means to facilitate retainment of the individual paper sheet members included therein; and (d) a removal arm secured with respect to said upper member and extending downwardly and outwardly therefrom to a distance greater than the distance to which said base member extends from said end member to abut the upper surface of the paper pad means at an oblique angle with respect thereto, said removal arm including a cutting edge thereon flexibly biased into abutment with the upper surface of the paper pad means to facilitate removal of individual sheets therefrom.

17. An improved paper pad securement clip means for use with a paper pad means as defined in claim 16 wherein said cutting edge of said removal arm is sharpened to approximately a 60 degree angle thereon.

18. An improved paper pad securement clip means for use with a paper pad means as defined in claim 16 wherein said removal arm is integral with respect to said upper member.

19. An improved paper pad securement clip means for use with a paper pad means as defined in claim 16 wherein said removal arm is flexibly resilient with respect to the upper surface of the paper pad means to maintain abutment therewith after removal of a fraction of the number of individual paper sheet members positioned within the paper pad.

20. An improved paper pad securement clip means for use with a paper pad means including a plurality of individual paper sheet members stacked vertically upon one another, the paper pad means defining a base surface therebelow, an upper surface thereabove, and an edge gluing means extending along one edge of the paper pad means to facilitate initial retainment of the individual paper sheet members with respect to one another, said improved paper pad securement clip means comprising:

(a) an end member extending over one edge of the paper pad means over the edge gluing means to facilitate retainment thereof, said end member including an upper end and a lower end defined thereon;

(b) a base member secured with respect to said lower end of said end member and extending outwardly therefrom across the base surface of the paper pad means, said base member including a base abutment arm extending upwardly therefrom and being approximately perpendicular with respect thereto, said base member being flexibly resilient to urge said base abutment arm to exert an upwardly directed bias against the base surface of the paper pad means to facilitate retainment of the individual paper sheet members included therein;

(c) an upper member secured with respect to said upper end of said end member and extending outwardly therefrom across the upper surface of the paper pad means, said upper member including an upper abutment arm extending downwardly therefrom and being approximately perpendicular with respect thereto, said upper member being flexibly resilient to urge said upper abutment arm to exert a downwardly directed bias against the upper surface of the upper pad means to facilitate retainment of the individual paper sheet members included therein; and (d) a removal arm integral with respect to said upper member and extending downwardly and outwardly therefrom to a distance greater than the distance to which said base member extends from said end member to abut the upper surface of the paper pad means at an oblique angle with respect thereto, said removal arm including a cutting edge thereon sharpened to approximately a 60 degree angle thereon and flexibly biased into abutment with the upper surface of the paper pad means to facilitate removal of individual sheet therefrom, said removal arm being sufficiently flexibly resilient with respect to the upper surface of the paper pad means to maintain abutment therewith after removal of a fraction of the number of individual paper sheet members positioned within the paper pad.

* * * * *

UNITED STATES PATENT AND TRADEMARK OFFICE

CERTIFICATE OF CORRECTION

PATENT NO. : 5,112,083

DATED : May 12, 1992

INVENTOR(S) : Ross Morrone

It is certified that error appears in the above-identified patent and that said Letters Patent is hereby corrected as shown below:

In column 6, line 63, change "sad" to -- said --.
In column 8, line 9, change "ad" to -- pad --.
In column 8, line 58, change "working" to -- wording --.
In column 8, line 61, change "member" to -- members --.
In column 9, line 13, change "bas" to -- base --.
In column 9, line 38, change "tacked" to -- stacked --.
In column 9, line 57, delete "a".
In column 9, line 58, change "rm" to --arm --.
In column 12, line 2, change "sheet" to -- sheets --.

Signed and Sealed this

Fourteenth Day of September, 1993

Bruce Lehman

*Attest:*

BRUCE LEHMAN

*Attesting Officer*

*Commissioner of Patents and Trademarks*